United States Patent [19]

Christopher

[11] 4,262,777

[45] Apr. 21, 1981

[54] HYDRAULIC ELEVATOR

[76] Inventor: Gordon W. Christopher, P.O. Box 826, Odessa, Tex. 79760

[21] Appl. No.: 67,040

[22] Filed: Aug. 16, 1979

[51] Int. Cl.[3] ..... B66B 11/04

[52] U.S. Cl. ..... 187/17; 187/26; 182/141

[58] Field of Search ..... 187/20, 17, 23, 26, 187/12, 7, 14, 95, 92, 93; 182/37, 38, 103, 141, 148; 254/189, 144

[56] References Cited

U.S. PATENT DOCUMENTS

| | | | |
|---|---|---|---|
| 605,820 | 6/1898 | Hancock | 187/92 |
| 759,087 | 5/1904 | Foley | 187/23 |
| 2,232,890 | 2/1941 | Stillwagon | 187/93 |
| 2,966,996 | 1/1961 | Friend, Jr. | 187/17 |
| 3,329,240 | 7/1967 | Harwood et al. | 187/95 |
| 3,500,963 | 3/1970 | Beutler | 187/17 |
| 3,592,294 | 7/1971 | Allen | 187/12 |
| 3,672,471 | 6/1972 | Badding | 187/92 |
| 3,934,681 | 1/1976 | Herrell | 187/17 |

*Primary Examiner*—F. J. Bartuska

*Assistant Examiner*—Kenneth Noland

*Attorney, Agent, or Firm*—Dennison, Meserole, Pollack & Scheiner

[57] ABSTRACT

A self-contained elevator structure including a pair of vertical, laterally spaced, parallel standards mounting a carrier or carrying cage for vertical travel therealong. Movement of the cage is effected by a multiple-sheave system actuated by a hydraulic piston and cylinder unit in turn controlled by three selectively operated switches, respectively at the top and bottom of the elevator structure, and on the traveling cage itself. The cage switch is capable of activation only when the cage gates or retaining bars are closed. The structure is positionable parallel to and closely adjacent a drilling rig platform with the control system for the vertically traveling cage enabling a stopping of the cage, and access to the rig platform, at any point along the vertical travel of the cage. Safety features include physically actuatable brakes provided on the cage, the use of switches which require constant pressure for actuation, and safety cables and braces between the rig and the standards.

4 Claims, 13 Drawing Figures

HYDRAULIC ELEVATOR

BACKGROUND OF THE INVENTION

The invention herein is concerned with self-contained elevator constructions which are intended to find particular utility as means for providing access, particularly for personnel, to the platform of a drilling rig.

The use of elevators in this particular environment is known, note for example U.S. Pat. No. 3,592,294 to Allen. However, the known elevator systems have been found to be less than completely satisfactory for a variety of reasons. For example, in the above-noted patent, the elevator assembly is positioned at an inclined angle to the rig platform, thus requiring the use of substantial ground area adjacent the rig and necessitating the provision of means for adjusting the carrying cage so as to maintain a horizontal orientation thereof. In addition, the projection of the elevator assembly forms an obstruction into the surrounding work area. Another readily noted disadvantage is the inability of the patented elevator to provide access to intermediate points along the rig platform between the ground and deck levels.

Known examples of general purpose vertical elevator systems, in some instances incorporating hydraulic actuators in association with cables or chains, are set forth in the following U.S. Pat. Nos.:

220,040 Swartz;
300,132 Rice;
2,770,324 Peterson;
3,003,584 Wiegand et al,
3,207,263 Cull;
3,360,078 Hopfeld;
3,344,890 Loef;
3,934,681 Herrell.

Such known elevator assemblies would find little utility in the particular environment of the invention due particularly to the construction and contemplated manner of operation as expressed in the various patents.

SUMMARY OF THE INVENTION

The present invention specifically comprises a self-contained elevator structure incorporating a vertically traveling personnel carrying cage hydraulically operated through a multiple-sheave assembly. A framework is provided including a pair of laterally spaced vertically elongated standards which define rails for the guided travel of the cage. The framework, and more particularly the vertical standards, directly support the operating components within a narrow housing formed along the length thereof with the entire structure engaged directly with and supported vertically closely adjacent to a drill rig platform or the like. The power plant, as a matter of convenience, will normally be mounted on a base immediately adjacent the lower end of the elevator. Manual controls include actuating switches provided at the upper and lower ends of the elevator structure, as well as on the cage itself. In each instance, activation of the switch requires constant pressure by the user with a release of the switch automatically deactivating the elevator as a safety feature.

The cage includes swinging gates thereon which, when open, deactivate the cage control switch. Appropriate foot actuated brake assemblies are also provided on the cage.

The actual means by which a raising and lowering of the cage is effected includes a sheave assembly incorporating a plurality of lower sheaves or pulleys mounted on a fixed cross-beam and a similar series of upper sheaves or pulleys mounted on a vertically traveling upper cross-beam, the upper beam being selectively vertically shiftable by a double-acting hydraulic piston and cylinder unit supplied through appropriate pump means associated with the power unit normally mounted adjacent the base of the elevator framework.

Further details of the construction and operation of the invention, as well as the objects and advantages thereof, will become apparent as the invention is more fully hereinafter described and claimed.

DESCRIPTION OF PREFERRED EMBODIMENT

Figure 1:
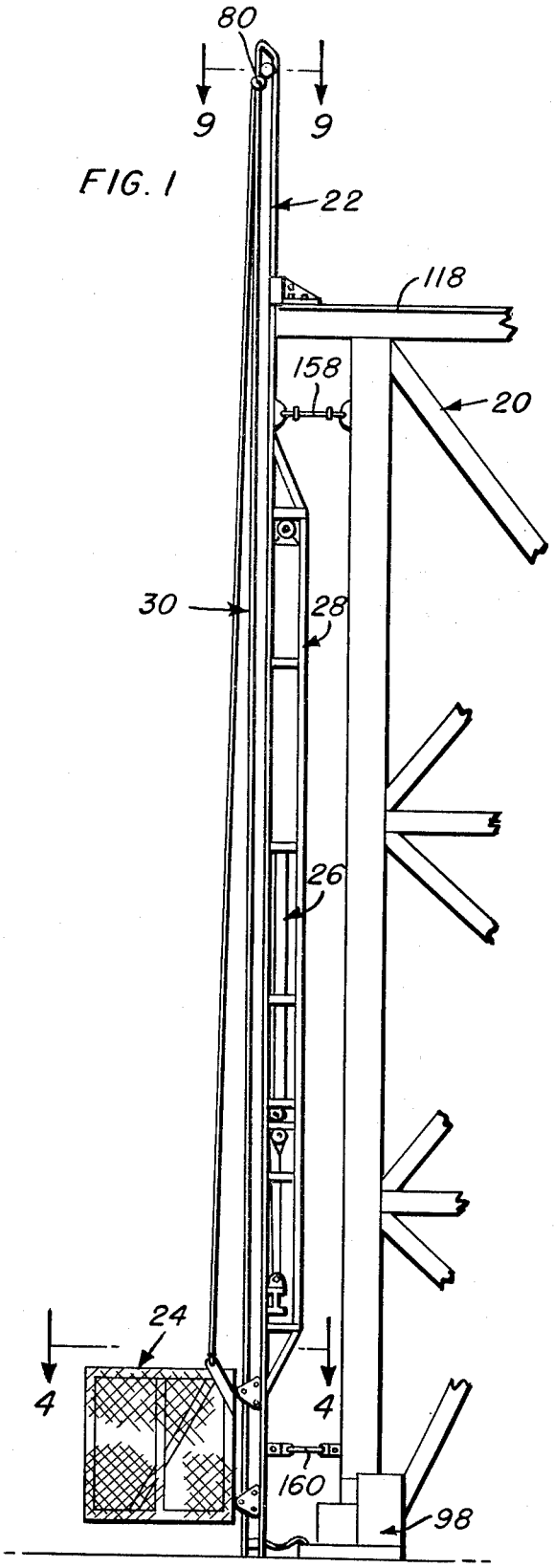
FIG. 1 is a side elevational view of the elevator construction of the present invention positioned in installed relationship adjacent a drilling rig platform.

The hydraulically operated elevator of the present invention, while not limited thereto, is particularly intended for use in conjunction with drilling rig platforms and the like. FIG. 1 illustrates the elevator mounted in operative position adjacent a drilling rig platform 20. It will be noted that the elevator has a thin profile and extends vertically parallel to one side of the platform 20 closely adjacent thereto. In this manner, only a minimal amount of the work area at the base of the platform is used, and no enlarged encumbering structures are required.

The elevator consists basically of a vertically elongated supporting framework 22, a carrier or carrying cage 24 mounted for vertical travel along the front face of the framework, and a lifting assembly 26 primarily housed within a vertically elongated narrow enclosure 28 mounted on the rear of the framework 22.

The framework 22 includes a pair of laterally spaced vertically elongated parallel standards 30. These standards 30 act as combined supports and guides for the vertically traveling cage 24, and are preferably elongated H-beams with the parallel flanges 32 and 34 thereof forming respectively the front and rear faces of the framework. The web of each H-beam standard 30 is designated by reference 36. Appropriate cross-beams will be provided at selected points along the height of the standards for a rigidification of the framework. Two such cross-beams 38 and 40 are provided, respectively, at the lower and upper ends of the framework 22. Additional cross-beams will also be provided, in many instances specifically located so as to mount the various operating components of the elevator as shall be presented subsequently. In order to facilitate the handling and positioning of the elevator, which is a self-contained assembly capable of being trucked to the field and installed as a unit, a pair of appropriate loading hitches 42 can be associated with the upper ends of the standards 30 and the top cross-beam 40, as will be readily noted in FIGS. 2 and 3 of the drawings.

The cage 24 consists of a rigid open box-like frame, preferably formed of square tubing, supporting a non-slip floor grate 46 and upstanding mesh walls 48. Front and rear access openings or passageways 50 are provided so as to allow entry into and exit from the elevator through both the front and rear of the cage.

A full height rearwardly projecting mounting plate 52 is fixed to, as by welding, and extends vertically along each side edge portion of the rear wall of the cage 24. Each mounting plate mounts one upper and two lower rollers 54, the peripheries of which project rearwardly beyond the plate and rollingly engage the front faces of the front flanges 32 of the standards 30, the two plates 52 being respectively in general vertical alignment with the two standards 30 as will be readily apparent from the drawings. The mounting of the rollers can be effected in any appropriate manner, such as for example by the provision of stub shafts projecting laterally from the plates with the rollers 54 rotatably mounted thereon.

Figure 4:
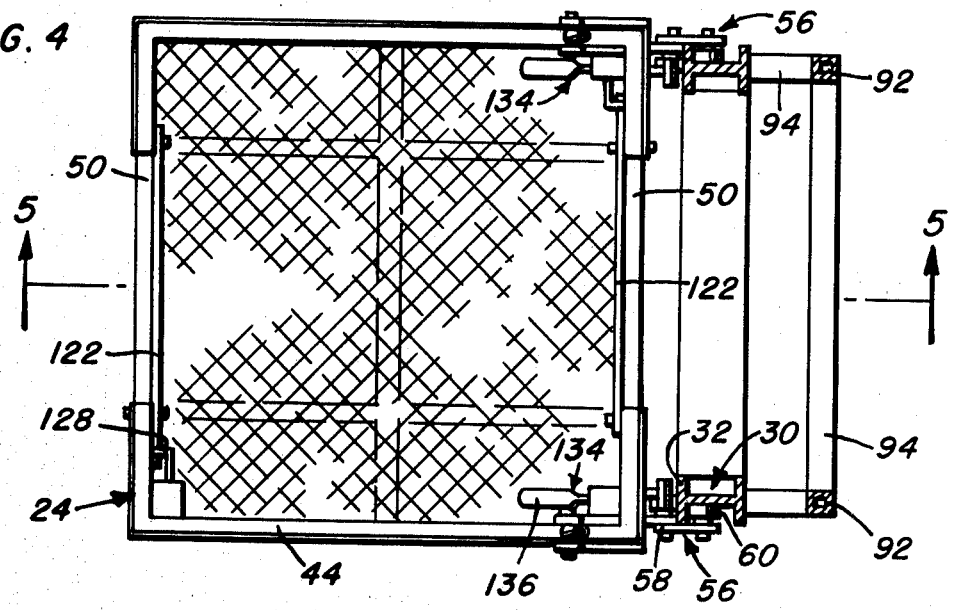
FIG. 4 is a top plan view taken substantially on a plane passing along line 4—4 in FIG. 1.
Figure 5:
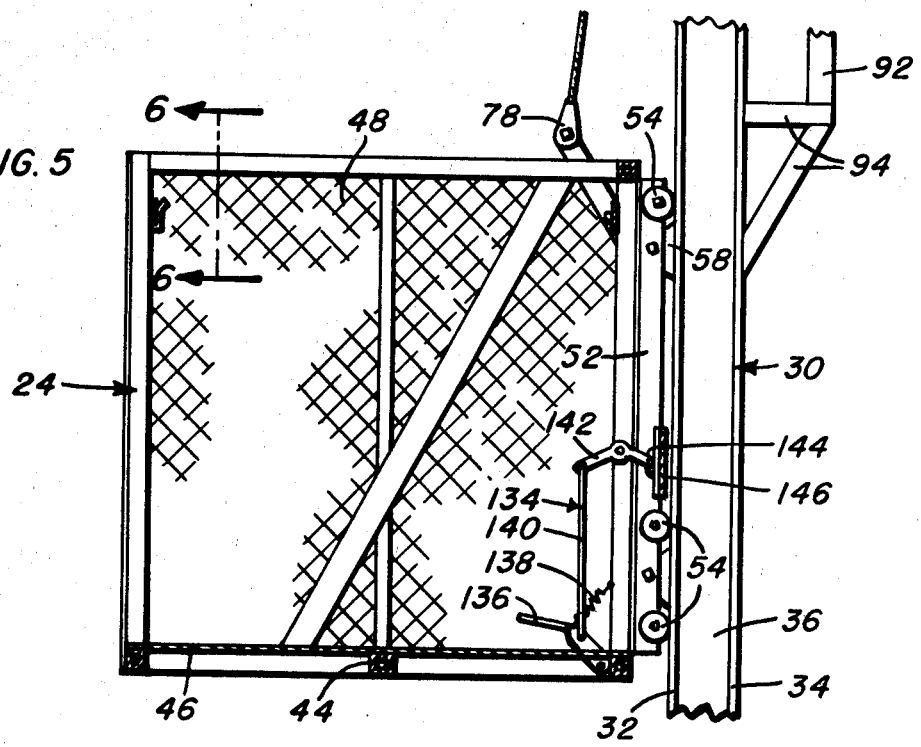
FIG. 5 is a vertical view taken substantially on a plane passing along line 5—5 in FIG. 4.

In order to retain the cage on the guide forming standards 30, and properly position the cage during the vertical travel thereof, each mounting plate 52 further mounts upper and lower beam trolleys 56. Each trolley 56 includes a plate 58 pinned or otherwise affixed to the corresponding mounting plate 52 and projecting rearwardly therefrom to a point rearward of the front flange 32 of the corresponding standard 30. Each trolley plate 58, rearward of the front flange 32, mounts a pair of vertically aligned trolley rollers 60 which engage against the rear face of the front flange 32 of the corresponding standard 30, thus in effect trapping the front flange 32 between the rear trolley rollers 60 and the front face engaging rollers 54. As will be appreciated from FIG. 4 in particular, the trolley rollers, both engaged outward of the standard webs 36, similarly function so as to retain the cage 24 against any lateral shifting relative to the standards.

The lifting assembly 26, by which the desired raising and lowering of the cage 24 is effected, is mounted on the rear face of the framework 22, and consists basically of a multi-sheave assembly 62 and a double-acting hydraulic ram or piston and cylinder unit 64.

Figure 10:
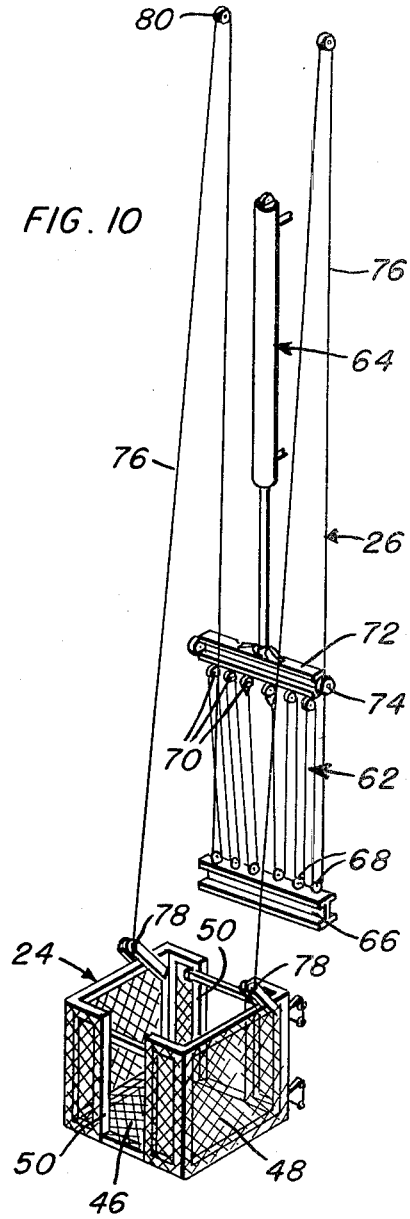
FIG. 10 is a schematic illustration of the carrier cage and control means therefore.
Figure 7:
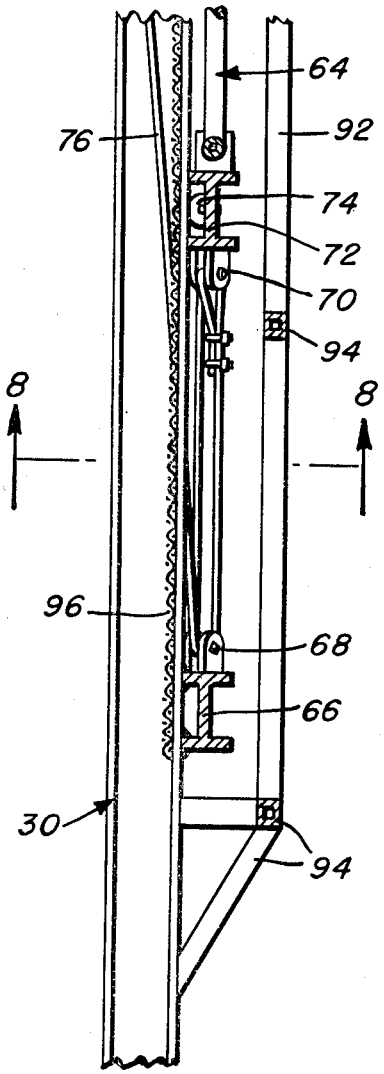
FIG. 7 is an elevational detail of the sheave assembly and associated portion of the framework.
Figure 9:
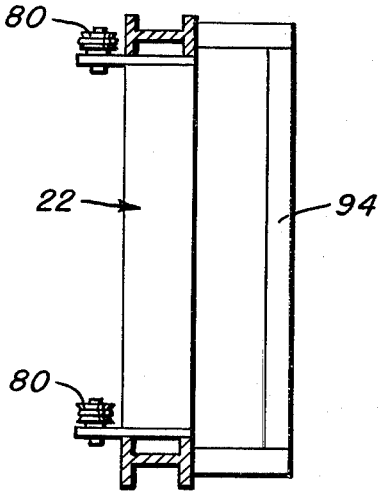
FIG. 9 is a cross-sectional detail taken at the upper end of the framework substantially on a plane passing along line 9—9 in FIG. 1.
Figure 8:
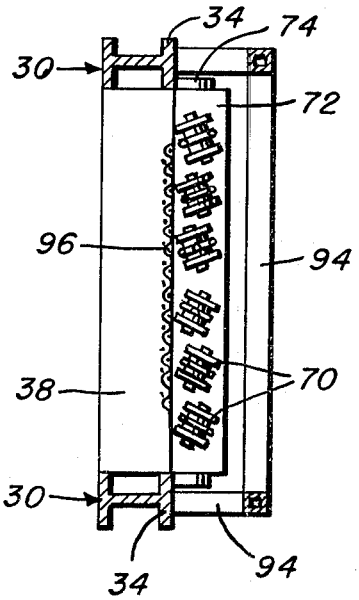
FIG. 8 is a horizontal cross-sectional detail taken substantially on a plane passing along line 8—8 in FIG. 7.

The multiple-sheave assembly 62 includes a lower beam 66 positioned transversely across and welded to the rear faces of the standards 30 so as to additionally function as a frame rigidifying member. Two groups of upwardly projecting sheaves 68 are mounted on the upper face of the beam 66. A similar two groups of sheaves 70 are mounted on and depend from the lower face of a traveling beam 72 paralleling the beam 66 in upwardly spaced relation thereto. The beam 72 includes rollers 74 mounted thereon and positioned in rolling engagement with the rear planar faces of the rear flanges 34 of the standards 30. A pair of wire cables 76 are engaged between the carrier cage 24 and the sheave assembly 62 so as to effect the desired vertical movement of the cage 24 in response to a vertical shifting of the upper traveling beam 72. Each cable 76 includes a first end pin connected, as at 78, to one side of the cage 24 adjacent the upper rear edge thereof. The cable 76 extends from the cage about a free rotating pulley or sheave 80 rotatably mounted on the upper end of the corresponding standard 30. The cable then extends downward and engages about one pair of lower and upper groups of sheaves 68 and 70 in a manner which will be best appreciated from FIGS. 2, 3 and 10. The second end of each cable 76 is fixed to the innermost sheave of either the corresponding upper or lower group of sheaves. The distance of travel of the upper traveling beam 72, as well as the number of sheaves in the cooperating groups of sheaves, will determine the length of vertical travel of the cage 24. It is to be appreciated that while, in the drawings, each cable 76 has been presented as passing over five sheaves in the multiple-sheave assembly 62, the number of actual sheaves can vary depending upon the height of the elevator and the vertical travel desired for the cage 24. FIGS. 7 and 8 are of interest in illustrating the slightly angled orientation of the sheaves of the sheave assembly 62 so as to provide for a smooth engagement and movement of the cables about the sheaves.

Figure 2:
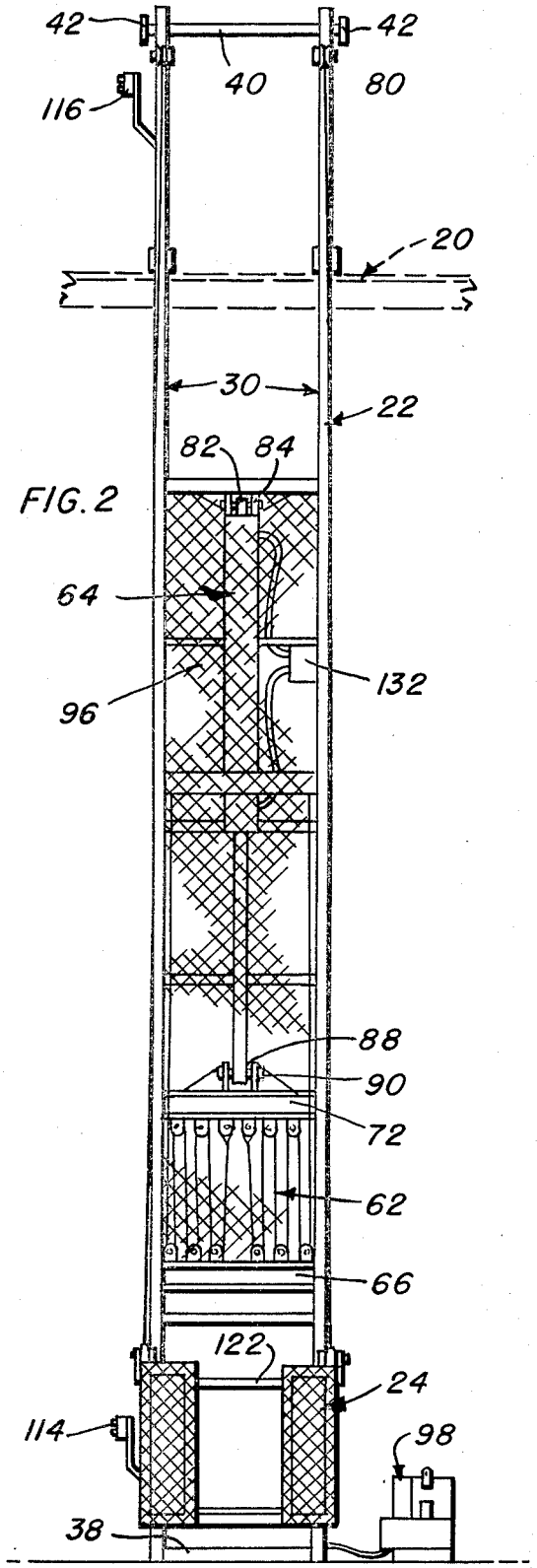
FIG. 2 is a front elevational view of the elevator structure with the carrier cage in a lowered position.
Figure 3:
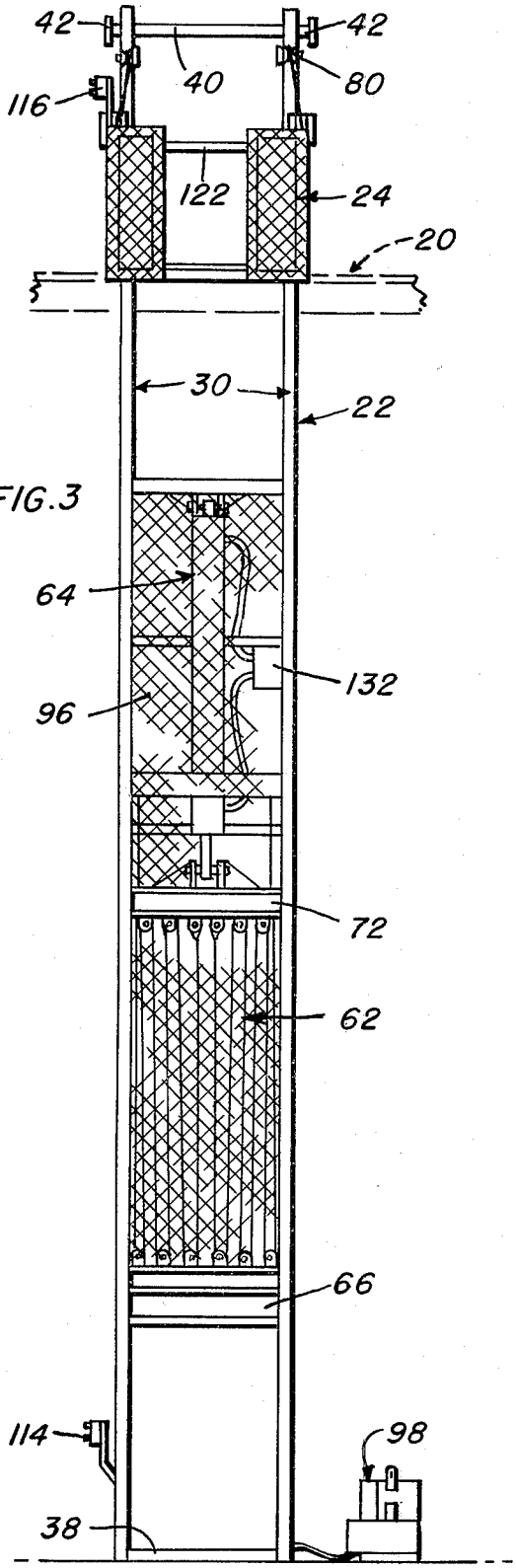
FIG. 3 is a front elevational view similar to FIG. 2 with the carriage cage in an elevated position.

With reference to FIGS. 2 and 3, it will be recognized that the multiple-sheave assemblies allow for a vertical movement of the cage 24 which is substantially greater than the movement producing vertical travel of the traveling beam 72. The actual vertical shifting of the traveling beam 72 is effected by the double-acting hydraulic ram or piston and cylinder unit 64. The upper end of the ram 64, which constitutes the outer end of the cylinder, is pinned, as at 82, between a pair of depending ears welded centrally to the undersurface of a cross-beam 86 extending between and welded to the rear faces of the standards 30. The lower end of the hydraulic ram 64, that is the outer end of the piston, is in turn pinned between a pair of upstanding rigid ears 90 fixed centrally to the upper surface of the traveling beam 72.

With such an arrangement, and again noting FIGS. 2 and 3, a retraction of the hydraulic ram 64, by an inward drawing of the piston into the ram, will effect a corresponding upward movement of the traveling beam 72, an effective lengthening of the cables between the sheave groups, and an upward drawing of the carrier cage 24. By the same token, an extension of the piston outward from the cylinder will correspondingly reduce the amount of cable accommodated by the sheave groups within the sheave assembly 62, and enable a gravitational downward travel of the cage 24, the effectve lengthening of the cables 76 being controlled by the action of the piston and cylinder unit 64. If so desired, and in order to assure proper vertical travel of the traveling beam 72, guide trolleys, similar to the trolleys on the cage 24, can also be provided on the traveling beam 72. Further, appropriate cross bracing can be utilized to stabilize the hydraulic ram 64, and particularly the cylinder thereof.

As a protective means, both for the lifting assembly 26 and the users or occupants of the elevator, it is contemplated that the lifting assembly be provided with an open framework housing or enclosure 28 consisting of a pair of laterally spaced vertical uprights 92, paralleling the standards rearwardly thereof, and appropriate cross bracing 94 extending both between the uprights 92 and between the uprights and the adjoining standards 30. In addition, an appropriate protective openwork mesh 96 can be provided both on the enclosure forming members 92 and 94, and on the standards 30, out of the way of the operating components, for the height of the lifting assembly 26.

Figure 12:
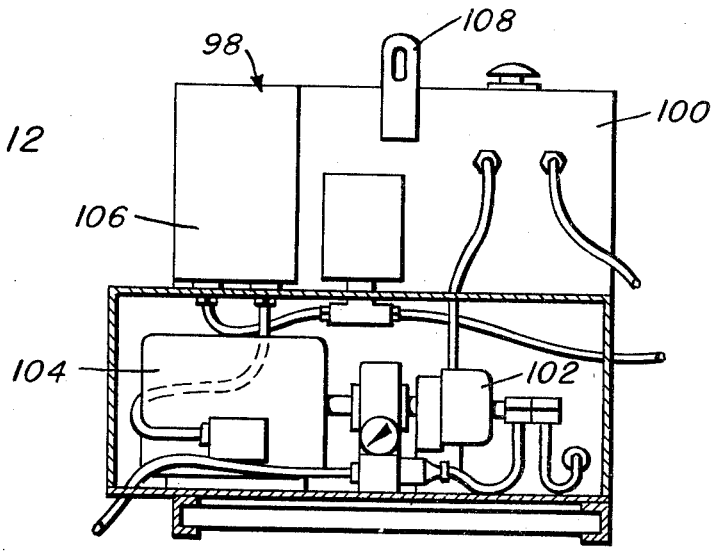
FIG. 12 illustrates various components of the base mounted power plant.

A power plant 98, normally skid mounted and positioned adjacent the base of the elevator, provides the necessary power for operation of the hydraulic unit 64. This plant, as suggested in FIG. 12, will include, as one example, a 40 gallon volume tank 100, a hydraulic pump 102, an explosion-proof electric motor 104, a housing 106 enclosing a master power switch, and appropriate pressure relief valves, pressure gauges, and the like. If so desired, one or more lifting eyes 108 can also be provided so as to facilitate a positioning of the power plant 98.

Figure 13:
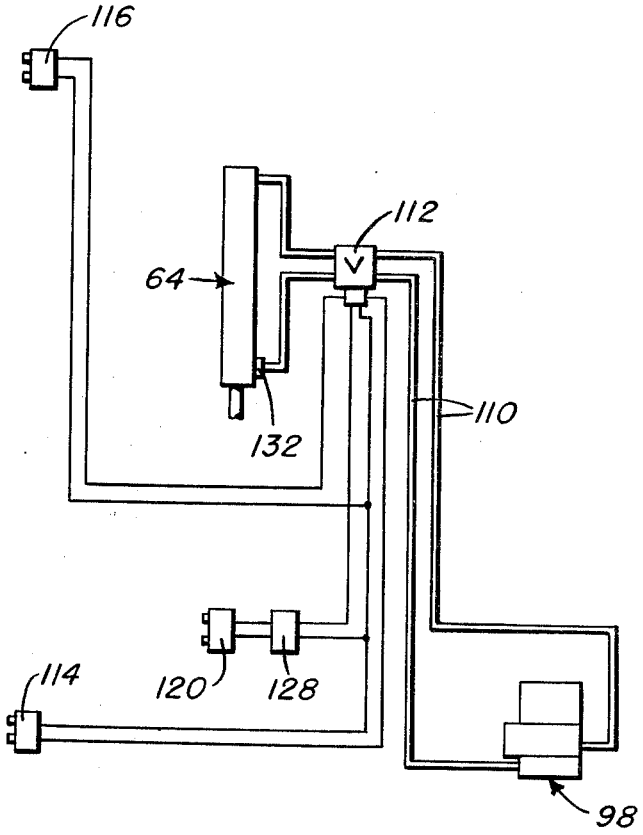
FIG. 13 schematically illustrates the hydraulic ram system and switch control therefor.

Noting the basic schematic illustration of FIG. 13, the hydraulic flow, through the lines 110 from the power unit 98 to the hydraulic unit 64, is controlled by a solenoid operated hydraulic valve 112. Operation of the solenoid controlled valve 112 is to be effected independently from three separate switches, a first switch 114 located at the lower end of the elevator, a second switch 116, located at the upper end of the elevator, and accessible from the deck 118 of the drilling rig platform 20, and a third switch 120 operable from the cage itself. In each instance, the switch is to incorporate a spring return, or other appropriate means whereby actuation requires constant manual pressure. In other words, release of the switch results in an automatic deactivation of the valve-controlling solenoid. With such an arrangement, there is an instantaneous and effective control over the operation of the cage 24. Further, the provision of remote switches at the upper and lower ends of the elevator enable a user, at a remote location, to control the travel of the elevator without requiring an occupant within the cage.

Figure 6:
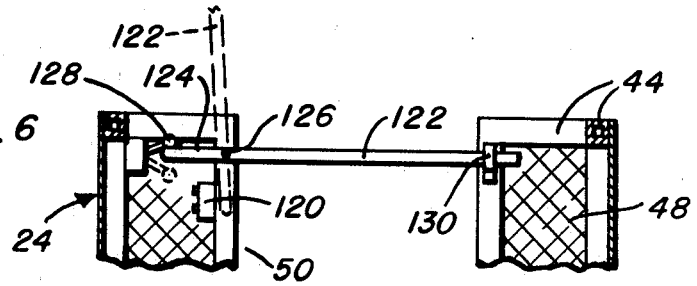
FIG. 6 is a cross-sectional detail taken substantially on a plane passing along line 6—6 in FIG. 5.

As a safety feature, when the cage is operated, both access passageways or openings 50 through the front and rear walls of the cage 24 are provided with pivotally mounted upwardly swinging crossbars 122. Each of these bars 122, noting FIG. 6 in particular, has an end portion 124, projecting longitudinally beyond the point of pivotal mounting 126, which physically engages and closes an adjoining switch 128 upon a closing of the crossbar 122, the remote end of which may be engaged within an appropriate retaining clip 130. Until such time as the switch 128 is closed, no power is supplied to the main cage switch 120 and no operation of the cage can be effected therefrom.

As illustrated, the switch 128 includes an appropriate spring return whereby, upon an upward swinging of the crossbar 122, and a removal of the pressure from the switch 128, the switch 128 automatically switches off and interrupts power to the main switch 120. However, other appropriate means can be provided for activation and deactivation of the switch 128 in response to movement of the crossbar 122. Incidentally, inasmuch as two crossbars 122 and associated switches 128 are provided, it is to be appreciated that both crossbars 122 must be closed to enable actuation of the switch 120. Further, if deemed desirable, the controls can be so modified as to similarly prevent operation of the lower and upper switches 114 and 116 until such time as the crossbars 122 and associated switches 128 are closed.

Additional safety factors include the specific location of the various electrical and hydraulic lines within the confines of the H-beam standards, and the provision of an appropriate back pressure safety check valve, schematically designated at 132 in FIG. 13, specifically designed to lock the cylinder in the event of a break in any pressure line.

It is also contemplated that a pair of foot actuated brake systems 134 be provided on the cage 24 itself, one associated with each of the standards 30. Each brake system includes a foot pedal 136 pivotally mounted at one end thereof to the cage framework at a lower rear corner of the cage 24. The pedal 136 is resiliently biased upward by appropriate spring means 138 so as to present a readily accessible generally horizontal enlarged flat foot receiving portion. A vertically extending flat bar link 140 is pivoted at its lower end to the pedal 136 remote from the pivot thereof, and at its upper end to one end of a pivot bar 142. The pivot bar, which is angularly configured, is in turn pivotally mounted, at the mid or apex portion thereof, to a corner vertical frame member of the cage 24. The remote end of the pivot bar mounts, through a limited pivot connection 144, the brake pad assembly 146. This assembly, upon a stepping on of the pedal 136, is brought into friction bearing engagement with the forward face of the front flange 32 of the corresponding standard 30, producing in turn a braking action.

Figure 11:
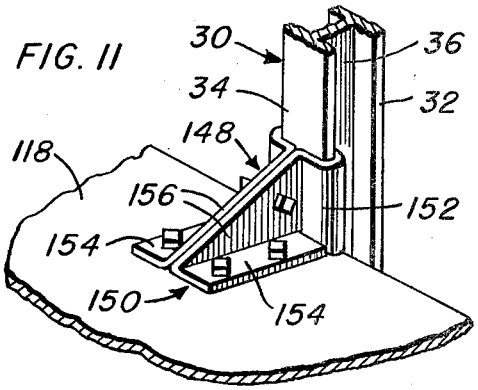
FIG. 11 is a perspective detail illustrating the manner of engaging the upper portion of the framework with the deck of a drilling rig.

As will be noted from FIG. 1, the self-contained elevator structure of the present invention is particularly adapted to mount parallel to and closely adjacent the drilling rig platform with the carrier cage 24 outwardly directed and the enclosed lifting assembly inwardly directed. Basically, the lower end of the elevator framework 22 will be supported either directly on the ground or on an appropriate base, slab or the like. The upper end portion of each standard 30, referring also to FIG. 11, will be locked to the platform deck 118 by a clamp assembly 148. This assembly 148 includes two angular sections 150, each in turn having a vertical laterally inwardly directed flange 152 of a generally U-shaped full-height configuration which is received about and encompasses approximately one half of the inner flange 34 of the corresponding standard 30. The flanges 152 of the two sections 150 receive and enclose substantially the entire flange 34 in a manner so as to specifically preclude relative lateral movement therebetween.

Each of the sections 150 further includes a right angularly directed flange 154 which is received on and directly bolted to the platform deck 118. Further stability can be introduced into the assembly 148 by the provision of inner gusset-like plates 156 on each of the sections 150, with these plates 156 in turn being directly bolted together.

It is also contemplated that a safety cable 158 be engaged between the upper portion of each standard 30 and the adjoining structure of the drilling rig platform 20. This safety cable 158 can be secured in any appropriate manner, for example by a looping of the opposite ends thereof through mounting eyes and a subsequent clamping of the looped ends.

Further stability is introduced into the elevator structure by means of rigid rods 160, normally provided between the lower portion of each standard 30 and the adjoining platform structure. While any manner of attachment can be used, it is particularly contemplated that the opposite ends of the rigid rods 160 be pin connected with the standards and platform framework having appropriate pin-receiving apertured ears provided thereon.

While the elevator structure, being self-contained, is readily transported to the work site, it is contemplated that, when installed, the structure be considered at least a semipermanent installation, rather than a portable structure adapted to be readily moved from one drilling rig platform to another. Further, and as previously indicated, when installed, the elevator structure fits compactly along one side of the drilling rig platform and requires the use of only a bare minimum of the work area about the platform. The height of the structure can vary in accordance with the height of the platform with which it is associated. As will be appreciated from FIGS. 1, 2 and 3, the standards 30 are to project sufficiently above the platform deck 118 so as to allow elevation of the cage 24 to the deck 118. Further, while cross bracing is desired at selected points along the height of the standards 30, such cross bracing must be positioned so as to not interfere with free access between the cage 24 and the platform deck 118.

The foregoing is considered illustrative of the principles of the invention. Further, modifications and changes, which may occur to those skilled in the art, may be resorted to, as falling within the scope of the invention.

I claim:

1. For use in conjunction with a drilling rig platform or similar closely adjacent vertical structure, an elevator, said elevator including a vertical framework adapted to parallel said closely adjacent vertical structure, said framework comprising laterally spaced support standards defining vertical guides, mounting and stabilizing means fixed to said standards and projecting rearwardly therefrom for engagement with said drilling rig platform or similar closely adjacent vertical structure to maintain said standards in closely spaced parallel relation thereto, a carrier cage positioned generally forward of said standards, means on said cage engaging said standards for guided movement of the cage therealong, a multiple-sheave assembly positioned generally rearward of said standards, said multiple-sheave assembly comprising a cross-beam fixed to and extending transversely between said standards, multiple sheaves mounted on said cross-beam, a traveling beam positioned in a spaced parallel relation over said cross-beam, means engaged between the traveling beam and the standards for guiding movement of the traveling beam along said standards, and multiple sheaves mounted on said traveling beam, a pulley mounted on each of said standards, first cable means engaged about selected ones of the multiple sheaves of the multiple-sheave assembly and extending therefrom about the pulley mounted on one of said standards to anchored engagement with said cage, second cable means engaged about selected ones of the multiple sheaves of the multiple-sheave assembly and extending therefrom about the pulley mounted on the other of said standards to anchored engagement with said cage, and power means for effecting a selective vertical movement of said traveling beam, relative to said cross-beam, said first and second cable means, upon a movement of said traveling beam, effecting a corresponding movement of said cage.

2. The construction of claim 1 wherein said power means comprises a hydraulic piston and cylinder unit fixed at one end to said framework centrally between said standards, and fixed at the second end to said traveling beam, a power plant communicated with said hydraulic unit for the supplying of pressurized fluid thereto, valve means for regulating fluid flow between said power plant and said hydraulic unit, and three separate controls for said valve means mounted respectively at the upper and lower end portions of said standards and on said cage, each control being independently activatable for controlling said valve means.

3. The construction of claim 2 wherein said cage includes front and rear passageways for enabling movement to and from said cage, removable barrier means for each passageway, and switch means responsive to removal of said barrier means for deactivation of the cage mounted control.

4. The construction of claim 3 wherein the means on said cage engaging said standards for guided movement therealong comprise roller means mounted on said cage and projecting rearwardly therefrom into engagement with said standards, said roller means engaging said standards in a manner so as to retain said cage against lateral movement relative to said standards while allowing longitudinal movement of the cage along said standards.

* * * * *